US008214939B2

(12) United States Patent
Spurlock

(10) Patent No.: US 8,214,939 B2
(45) Date of Patent: Jul. 10, 2012

(54) SPLASH GUARD FOR WASHING BASIN

(76) Inventor: James R. Spurlock, Granbury, TX (US)

( * ) Notice: Subject to any disclaimer, the term of this patent is extended or adjusted under 35 U.S.C. 154(b) by 792 days.

(21) Appl. No.: 12/247,344

(22) Filed: Oct. 8, 2008

(65) Prior Publication Data

US 2010/0083440 A1 Apr. 8, 2010

(51) Int. Cl.
*E03C 1/244* (2006.01)
*A47J 47/20* (2006.01)

(52) U.S. Cl. ..... 4/654; 4/658

(58) Field of Classification Search ..... 4/654, 655, 4/657, 658; 137/801, 359; D23/308
See application file for complete search history.

(56) References Cited

U.S. PATENT DOCUMENTS

| | | | | |
|---|---|---|---|---|
| 406,198 | A | 7/1889 | Coyne | |
| 1,728,502 | A * | 9/1929 | McGregor | 4/656 |
| 2,635,253 | A | 4/1953 | Kirvay | 4/187 |
| 2,692,991 | A | 11/1954 | Church | 4/187 |
| 2,762,062 | A | 9/1956 | Barton | 4/189 |
| 4,722,103 | A | 2/1988 | Kliebert | 4/658 |
| D325,249 | S | 4/1992 | Kliebert | D23/308 |
| D329,280 | S | 9/1992 | Draucek, Sr. | D23/308 |
| 5,625,910 | A * | 5/1997 | Erickson et al. | 4/658 |
| 6,212,708 | B1 * | 4/2001 | Mulaw | 4/657 |
| 2004/0099617 | A1 * | 5/2004 | Elias et al. | 211/41.3 |
| 2007/0261165 | A1 * | 11/2007 | Tran | 4/661 |
| 2009/0094741 | A1 * | 4/2009 | Valadez et al. | 4/658 |

* cited by examiner

*Primary Examiner* — Gregory Huson
*Assistant Examiner* — Janie Christiansen
(74) *Attorney, Agent, or Firm* — Whitaker Chalk Swindle & Schwartz PLLC; Stephen S. Mosher

(57) ABSTRACT

A splash guard for installation on a washing basin having a faucet assembly mounted proximate an edge of said basin, said splash guard comprising a one piece, generally concave shell having a floor portion with one or more openings for water supply plumbing to said faucet assembly and an upwardly curved rear wall portion integral therewith for directing splashed material impinging thereon into said washing basin.

19 Claims, 14 Drawing Sheets

SPLASH GUARD FOR WASHING BASIN

BACKGROUND OF THE INVENTION

1. Field of the Invention

The present invention generally relates to washing basins, lavatories, and sinks and more particularly to apparatus to be used with such washing basins for preventing deterioration of supporting structures due to leakage of water and other liquids during use of the washing basin.

2. Background of the Invention and Description of the Prior Art

Use of washing basins frequently results in water or other substances being splashed beyond the periphery of the washing basin. If not immediately removed, often an inconvenient task, the accumulation of water can lead to water damage and deterioration of the cabinet structures that support the washing basin. For example, if seals are not effective or compromised by the accumulation of water, the water can attack the materials—usually wood—of the cabinet structure, causing the wood to rot, and accumulate mold, fungus, and mildew. Such deterioration can also present a risk to health because of organisms that may become established and flourish because of the presence of moisture and organic material, further causing unsanitary conditions adjacent the washing basin. These conditions are especially troublesome in kitchens where food is prepared, or in bathrooms where the lack of sanitary facilities can also be a risk to health. Moreover, any deterioration of the washing basin or its supporting structure is usually unsightly, requiring additional effort to clean and maintain the washing basin and its associated structures.

A number of solutions have been proposed to solve these problems. J. F. Kirvay, in U.S. Pat. No. 2,635,253 disclosed a two-piece "Shield For Linoleum Covered Sink Tops." The two pieces, one a flat, horizontal panel with holes that fit over the faucet stems, is designed to cover much of the back portion of a sink and is overlapped by an L-shaped panel that also has holes for the faucet stems. The vertical portion of the L-shaped panel is disposed against a wall or the backstop of the counter top supporting the sink. Both pieces are secured to the sink by the faucet hardware. There is no provision for water to drain from the surface of the assembly other than a rounded lip at the forward edge of the horizontal panel.

R. D. Church, in U.S. Pat. No. 2,692,991, also discloses a two-piece "Splash Guard For Sink Tops," designed for wash basins that have the faucet fixtures mounted on a vertical wall above the wash basin. It is otherwise similar to the Kirvay device and has the same deficiencies because of its two-piece design. G. W. Barton discloses in U.S. Pat. No. 2,762,062 a one piece "Protective Cover For Surfaces at Sinks," an L-shaped device having a lower portion that extends forward only enough to cross the rear border of the sink, without extending under the faucets. This design has the disadvantage that the area around the faucets is not protected from the accumulation of water. In fact, the design encourages water to flow toward the faucet area but not beyond it.

More recently, E. J. Kliebert, in U.S. Pat. No. 4,722,103 for a "Splash Guard," teaches a one piece curved panel that extends more or less vertically upward from the rear edge of a sink and has a cut out opening above the faucet assembly. It provides some protection against splashes and drains the water back into the sink. However, there is no provision to prevent accumulation of water around the faucet assembly. In addition, by configuring the panel to extend from just above the faucet assembly upward, access to the space along the back portion of the sink for cleaning is seriously impaired.

What is needed is a splash guard that protects the space and surfaces near the washing basin from splashing liquids, minimizes the accumulation of water around the faucet assemblies, provides for the drainage of splashed liquids back into the washing basin, and enables easy cleaning of the washing basin and the splash guard itself. Further, a splash guard for solving these problems should be easy to install, and maintain or improve existing seals around the faucet area.

SUMMARY OF THE INVENTION

Accordingly, there is disclosed an inventive splash guard for washing basins or lavatories that meets the foregoing objectives. Moreover, the invention is susceptible to numerous variations and embodiments without departing from the utility provided by the basic configuration, which will be illustrated through a description of a preferred embodiment. Persons skilled in the art will readily recognize not only the utility but also the adaptability of the design to many possible washing basin installations and products.

In one embodiment there is disclosed a splash guard for installation on a washing basin having a faucet assembly mounted proximate an edge of said basin, said splash guard comprising a one piece, generally concave shell having a floor portion with one or more openings for water supply plumbing to said faucet assembly and an upwardly curved rear wall portion integral therewith for directing splashed material impinging thereon into said washing basin.

In one aspect the splash guard comprises a one-piece shell formed of a thin, rigid material, the shell further comprising a substantially vertical rear wall portion that faces a user who is facing the washing basin and a substantially horizontal forward floor portion extending from a lower side of said rear wall portion, wherein said forward floor portion slopes slightly downward and away from said lower side of said rear wall portion.

In another aspect of the above embodiment, a receiving surface is provided on the splash guard for receiving at least one gasket member to seal the one or more openings for the water supply plumbing against passage of fluids between said water supply plumbing and the one or more openings. Further, the gasket may be disposed on the top or underside of the splash guard.

DETAILED DESCRIPTION OF THE INVENTION

Figure 1:
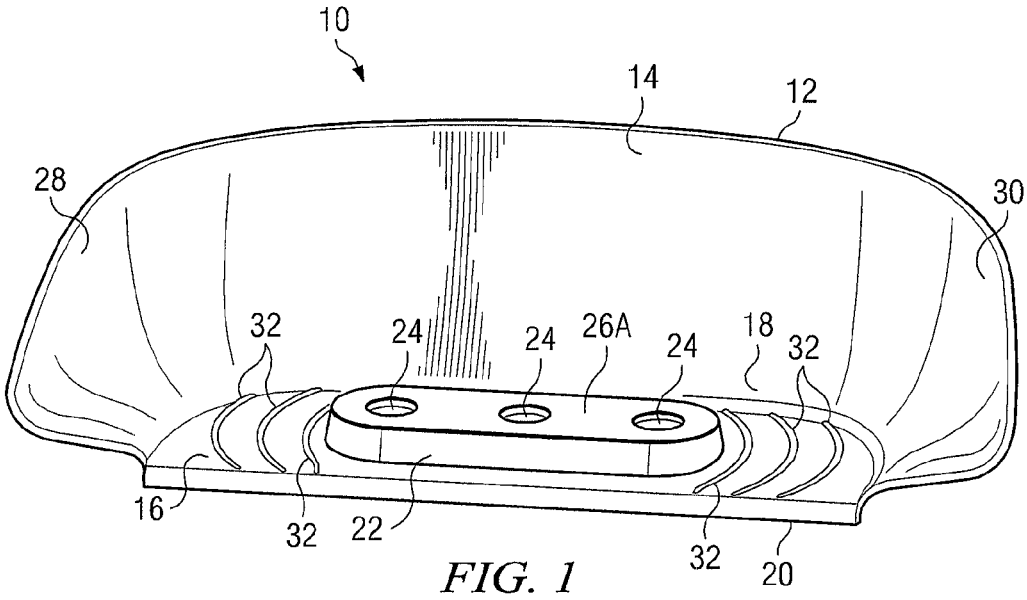
FIG. 1 illustrates a perspective view of one embodiment of a splash guard for a washing basin according to the present invention.

The following text, accompanied by the included drawings, describes and illustrates several embodiments of the present invention. The drawings include certain features that are essential and other features that may be included to adapt the invention to particular applications or to enhance its utility. In the drawings, reference numbers indicate the various structures or other features being described. Structures bearing the same reference numbers that appear in more than one figure are taken to be the same structure and their descriptions, in general, will not be repeated in detail. Further, the embodiments shown in the drawings are provided to illustrate the concept and principles of the invention but are not limiting thereof.

The invention is set forth in the appended claims. Further, the present invention, as will be recognized by persons skilled in the art, may be practiced in many forms and adaptations that may vary in appearance from the exemplary embodiments illustrated herein, yet retain the essential features recited in the claims. Thus, any alternative embodiment that includes the structural features recited in the claims are considered to fall within the scope of the claims that follow this detailed description.

FIG. 1 illustrates a perspective view of one embodiment of a splash guard for a washing basin according to the present invention. The ubiquitous washing basin, which is not part of the present invention, may be any of a wide variety of basins, lavatories, tubs, or sinks, whether made of metal, concrete, stone, glass, plastic, composite materials, etc. Such basins that provide washing facilities may be used in residential, commercial, industrial, governmental, private or public locations. Most are manufactured to standard sizes and configurations and lend themselves to use with standard plumbing and water supply fixtures mounted on one side of the washing basin. However, the present invention may be readily adapted to washing basins and faucet assemblies that differ from those illustrated herein, yet fall within the scope of the appended claims. Moreover, the present invention may be easily retrofitted to washing basins in existing installations to improve the utility thereof.

Figure 3:
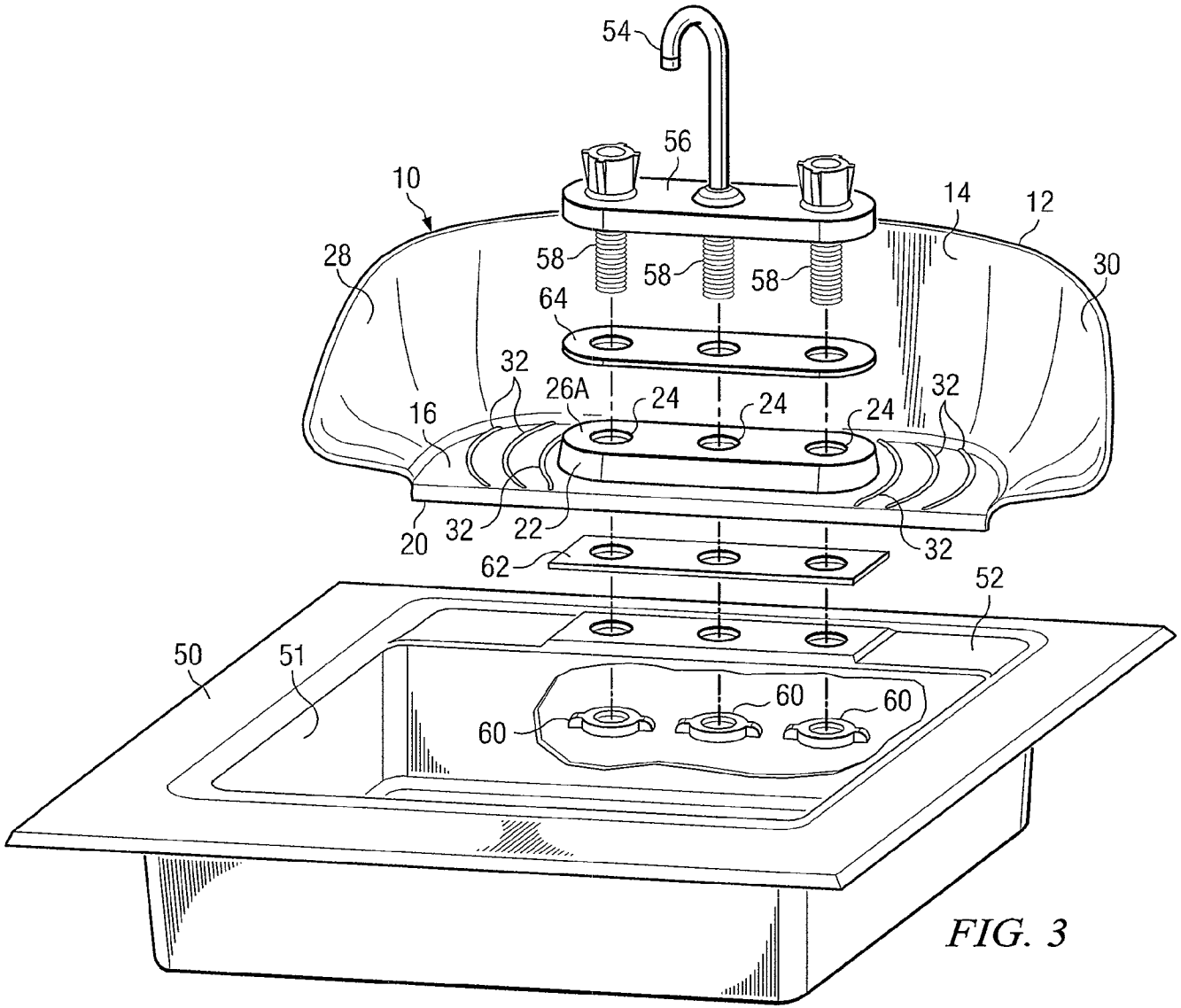
FIG. 3 illustrates an exploded perspective view of the embodiment of FIG. 1 being installed on a typical washing basin.

The splash guard 10 in one embodiment of the present invention shown in FIG. 1 comprises a one piece, generally concave shell 12 having a floor portion 16 with one or more openings 24 for water supply plumbing to a faucet assembly 54 (See FIG. 3) and an upwardly curved rear wall portion 14 integral therewith for directing splashed material impinging thereon into the washing basin 50 (Also shown in FIG. 3). The term concave in the preceding sentence is taken to mean a hollow or cavity having a curvature in at least one dimension, as in cylindrical, or in two or more dimensions as in a spherical curvature. Such a splash guard may be formed in a wide variety of shapes, sizes, and may have a particular configuration adapted to particular styles of washing basins. In a variation of the preceding embodiment, the splash guard 10 may comprise a one-piece shell 12 formed of a thin, substantially rigid material. The one piece shell 12 further includes a substantially vertical rear wall portion 14 having a forward facing front surface disposed such that it faces a user who is facing the washing basin 50; a substantially horizontal forward floor portion 16 extending from a lower side 18 of said rear wall portion 14; wherein said forward floor portion 16 slopes slightly downward and forward from said lower side 18 of said rear wall portion 14 toward a forward edge 20 of said forward floor portion 16; and said forward floor portion 16 includes a mounting base 22 for a faucet assembly 54 (See FIG. 3) having one or more faucet stem openings 24 for passage there through of water supply plumbing for said faucet assembly 54. The mounting base 22 may further include a gasket surface 26A on the upper surface thereof for receiving a gasket to be described in conjunction with FIG. 3.

In the embodiment of FIG. 1 the splash guard is configured with three openings 24 for the faucet and hot and cold water plumbing. Other embodiments may have two openings 24 or even one opening 24. Still other embodiments may have more than three openings 24, depending on the particular faucet or plumbing fixture assembly to be installed on the washing basin. For example, some faucet assemblies include spray hoses, dish washer vents, or even connections to other devices or appliances and the like. In such embodiments, all of which are contemplated herein by the inventor, the mounting base 22 would be configured accordingly, to provide a splash guard adapted to the particular style of washing basin.

Continuing with FIG. 1, the shell 12 may be formed of a thin, substantially rigid material such as polyurethane resin or an equivalent thermoplastic material, alloy, or composite may be formed in a variety of processes well known in the art such as cold casting, cold forming, hydro-forming, injection molding, and vacuum forming. Preferably, the thickness of a finished shell will be in the range of approximately 0.25 inch to 0.75 inch, depending on the stiffness and other properties of the material. The material may be any color, opaque or translucent or clear, depending on the base material, and the colorant used and the recipe for its use. Further, the resin or other material may be impregnated with an additive material that includes at least one material selected from the group of metals consisting of aluminum, brass, bronze, chromium, copper, gold, nickle, silver, and zinc. The additive material, generally included for decorative effects, may further include at least one material selected from the group of non-metals consisting of glass, minerals, pigments, plastics, stone, and other materials of organic origin. Additive materials may also be included to improve the structural performance of the material such as resistance to certain caustic substances, food acids, and the like.

The surface finish of the shell 12 of the splash guard 10 illustrated in the Figures should be able to shed water and other liquids readily, and should be non-porous to facilitate cleaning. In some embodiments, the floor portion 16 of the splash guard 10 may include guide ridges 32 that are configured to channel liquids toward the front edge 20 of the shell 12. The guide ridges 32 may be of relatively low altitude (e.g., 0.050 to 0.125 inch), spaced at approximate intervals of 0.50 inches or more, and follow a path that directs liquids to drain into the washing basin. The cross sectional profile of the guide ridges should avoid sharp angles, and be shaped to blend into the adjacent surfaces of the splash guard 10. In the description that follows, other features of the present invention will become clear as illustrated in the drawings.

Figure 2:
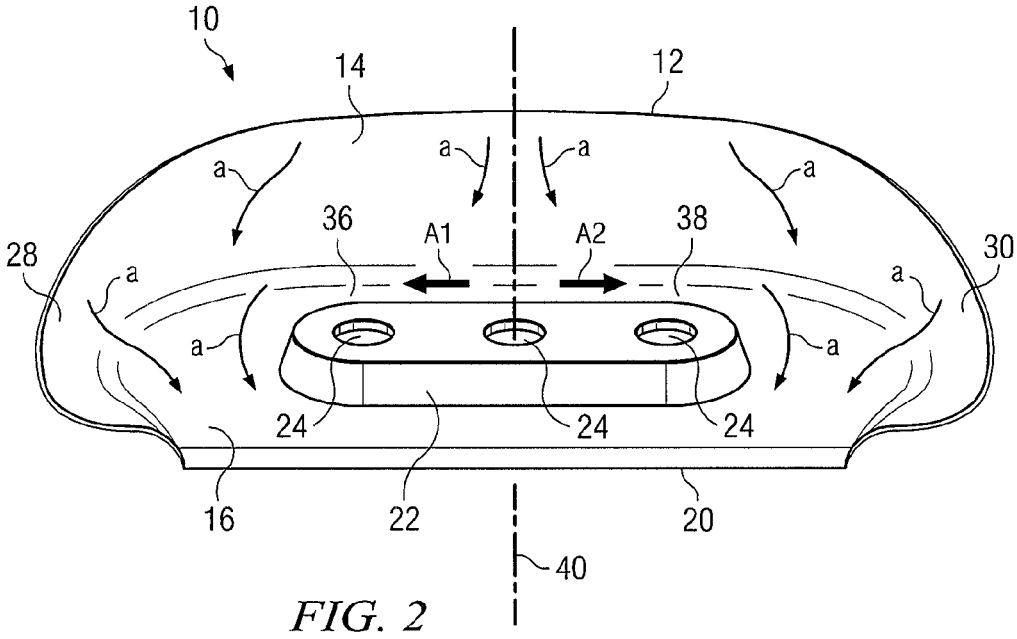
FIG. 2 illustrates a splash guard shell for the embodiment of FIG. 1 that shows the drain trough slope between the faucet base and the lower side of the vertical rear wall portion of the splash guard.

FIG. 2 illustrates a splash guard shell 12 for the embodiment of FIG. 1 that shows drain troughs 36, 38 formed between the faucet mounting base 22 and the lower side of the vertical rear wall portion 14 of the splash guard 10. The drain troughs, two of which are shown (36, 38) in FIG. 2, may be formed on either side of a center line 40, or other suitable reference, provide a slight downward slope to either side of the mounting base 22 to enable liquids to drain from that region toward the forward edge 20 of the splash guard 10. The downward slope in the drain troughs 36 (left hand) and 38 (right hand) is indicated by the broad arrows "A1" and "A2" in FIG. 2. It will thus be appreciated that all of the surfaces of the splash guard 10 have at least some downward slope to them. This feature prevents liquid materials from standing or accumulating on the splash guard 10 and facilitates rinsing of the surface of the splash guard 10 during cleaning. The thin arrows "a" in FIG. 2 indicate approximately the path of flow of liquid materials that impinge or are present on the surface of the splash guard 10.

FIG. 3 illustrates an exploded perspective view of the embodiment of the splash guard 10 shown in FIG. 1 being installed on a typical washing basin 50 with a faucet assembly 54. The splash guard 10 is placed on the washing basin 50 after a first gasket 62, if used, is placed on the faucet ledge 52 of the washing basin 50. The first gasket 62 may bear against a first gasket surface 26B on the underside of the mounting base 22 of the splash guard 10 (See FIG. 6). The faucet assembly 54 includes a base 56 and plumbing stems 58. After a second gasket 64 is placed on the gasket surface 26A of the mounting base 22, the plumbing stems 58, which may be threaded, are passed through the openings 24 as the faucet assembly 54 is installed on the combined splash guard 10 and the washing basin 50. The plumbing stems 58 may then be secured to the washing basin 50 using threaded lock down nuts 60 or other hardware supplied with the faucet assembly 54, thereby clamping the splash guard 10 and the washing basin 50 together. The splash guard 10 thus becomes a permanent extension of the washing basin to increase its utility and prevent deterioration of the surrounding area due to splashed liquids. The first and second gaskets 62, 64 may be fabricated of rubber or other resilient, liquid-impermeable material. The purpose of the gaskets 62, 64 is to seal the openings 24 against the seepage or leaking of liquids past the faucet stems 58.

Figure 4:
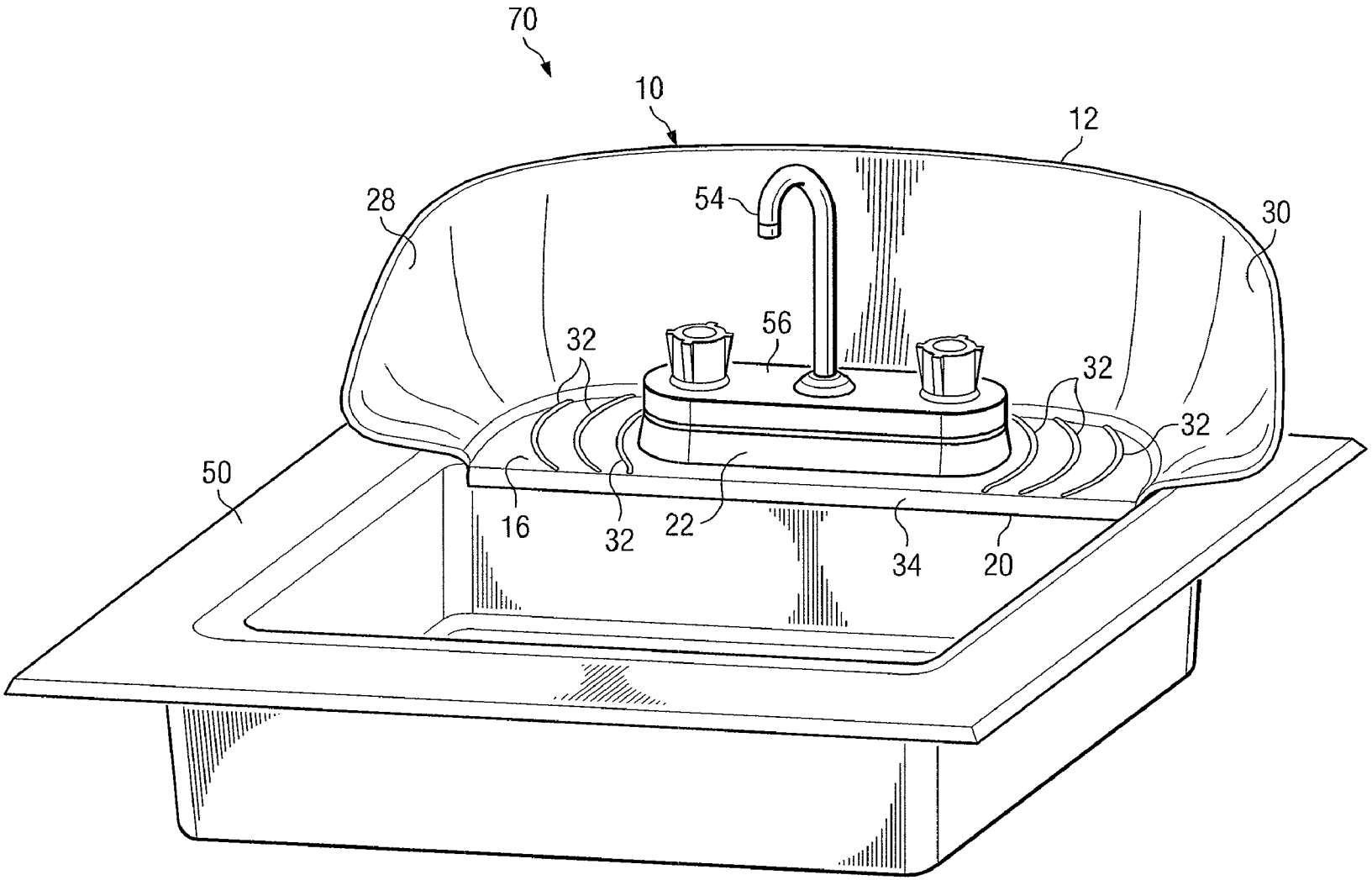
FIG. 4 illustrates a perspective view of the embodiment of FIG. 1 as installed on a typical washing basin.

FIG. 4 illustrates a perspective view of the embodiment of the splash guard 10 of FIG. 1 as installed on a typical washing basin 50. The installed splash guard 70 embodies all of the features illustrated in FIGS. 1 through 3. As installed, the splash guard is in position to drain whatever liquids impinge upon it into the washing basin 50 as it passes over the forward edge 20. It will also be observed that, in the embodiment shown, that the splash guard is configured dimensionally and by its shape to fit the washing basin 50 as though it were an extension thereof. Of course, the shape and the curvature of the edges and surfaces of the splash guard 10 may be provided to complement a particular washing basin. The embodiment shown is provided to illustrate the concept and principles of the invention as installed on a washing basin.

Figure 5:
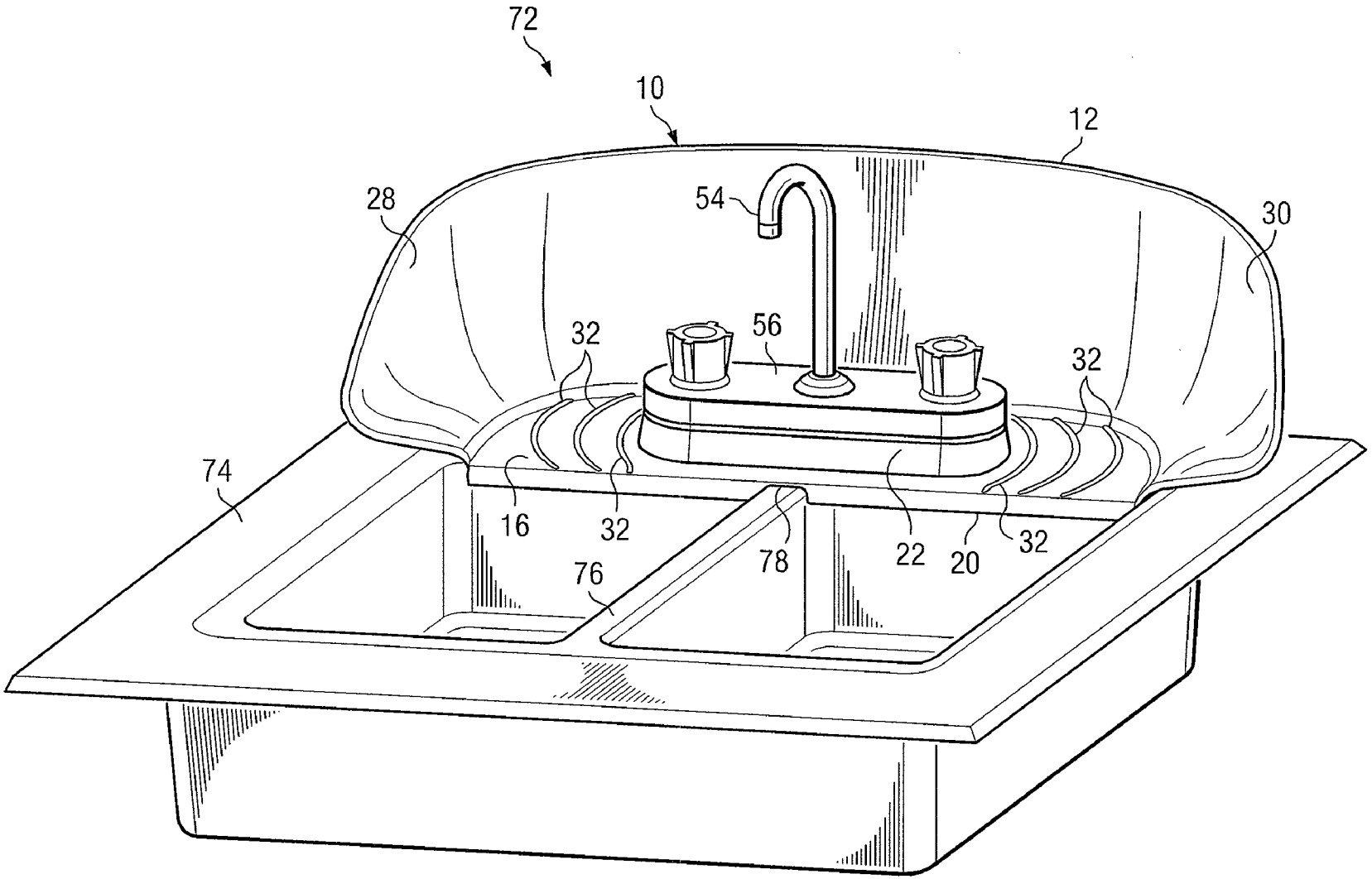
FIG. 5 illustrates a perspective view of an alternate embodiment of FIG. 1 as installed on a typical washing basin having two basins.

FIG. 5 illustrates a perspective view of an alternate embodiment of FIGS. 1 and 4 as installed 72 on a typical washing basin 74 having two basins separated by a partition 76. In the figure, the splash guard 10 has been modified slightly to accommodate the partition 76. The modification consists of a relief 78 formed in the forward edge 20 of the splash guard 10. In some embodiments, such as the one illustrated in FIG. 5, the relief 78 takes the form of a slight upset in the forward edge 20 of the splash guard 10. In other embodiments, depending on the shape and dimensions of the partition 76 the relief 78 may be simply a notch in the forward edge 20. In still other embodiments, the accommodation of the partition may be more elaborate as will be described in conjunction with FIGS. 14 though 15B herein below. It will be appreciated that FIG. 5 is illustrative and indicates that persons skilled in the art may modify the splash guard 10 in a variety of ways to accommodate particular configurations of the washing basin.

Figure 6:
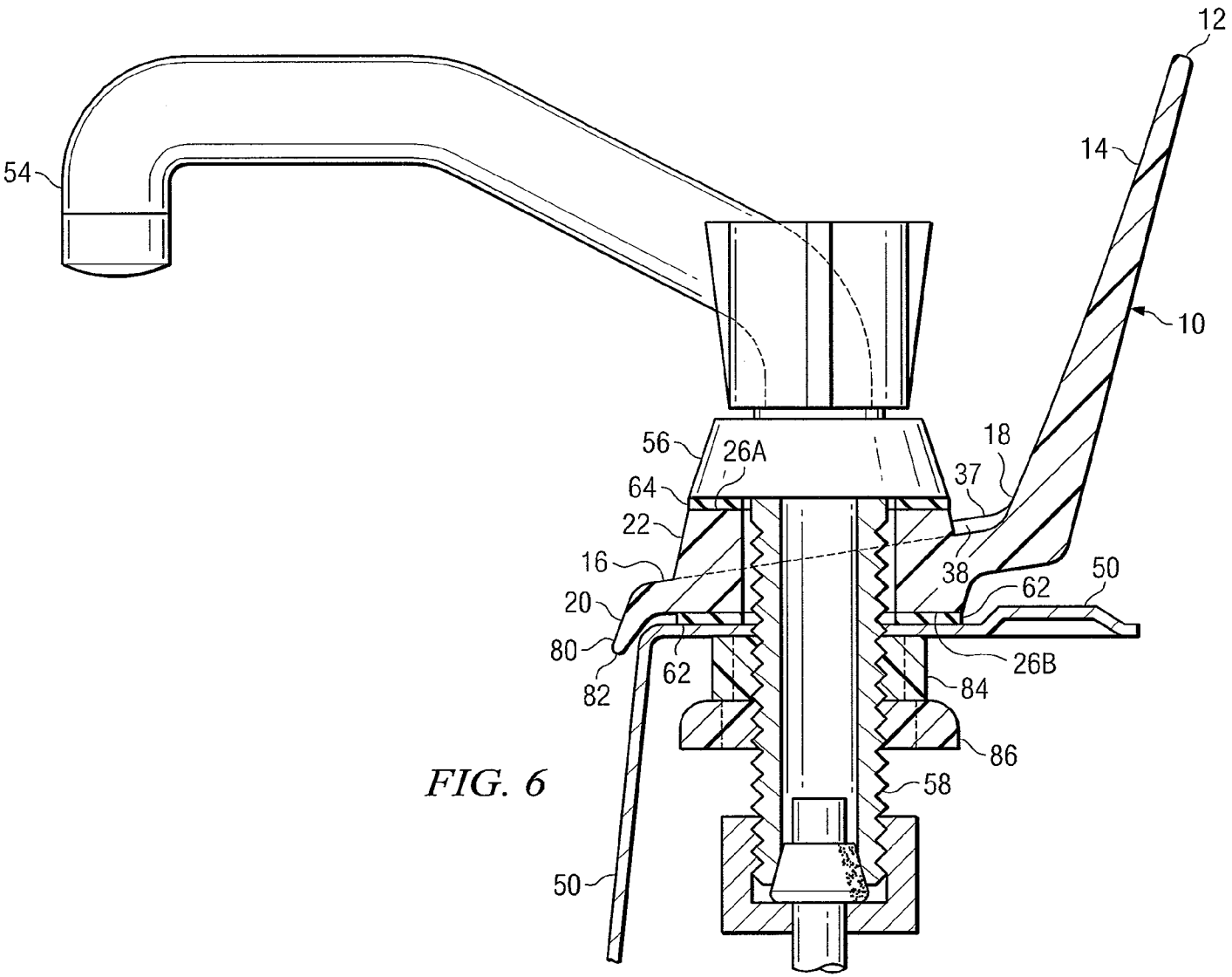
FIG. 6 illustrates a cross section view of the embodiment of FIG. 1 to show the relationship of components used in the installation of the splash guard.

FIG. 6 illustrates a cross section view of the embodiment of the splash guard 10 of FIGS. 1 through 4, cut approximately through the right-hand (near) faucet valve handle to show the relationship of components used in the installation of the splash guard 10 on a washing basin 50. Several features of the splash guard 10 previously described are visible in the drawing, including the general shape of the cross section thereof. For example, the substantially vertical rear wall portion 14, the substantially horizontal floor portion 16, the lower side 18 of the rear wall portion 14, the forward edge 20, and the faucet mounting base 22, including the first 26B and second 26A gasket surfaces. The forward edge 20 may be specially formed into an overhang 80 having a front surface and a rear surface that join and merge into a lip 82 that is configured to efficiently drip liquids therefrom. The profile of this overhang 80 and its lip 82 may be configured, for example, similarly to the trailing edge of an airfoil such as is used on an aircraft wing. In the space between the mounting base 22 and the lower side 18 of the rear wall portion 14 is seen the right hand drain trough 38 sloping downward and outward from the plane of the figure. At the center 37 of the splash guard 10 in this region the drain trough elevation above the surface of the floor portion is at a maximum.

Other structures appearing in FIG. 6 include the faucet 54, the faucet base 56, a faucet valve stem 58, and first and second gaskets 62, 64. In place of a single threaded lock down nut 60, there is shown a threaded lock down nut 84 and a threaded lock nut 86 used in combination that, when the lock nut 86 is tightened against the lock down nut 84, the two nuts 84, 96 become very resistant to loosening and secure the faucet assembly to the washing basin 50 and splash guard 10 together as an integral unit.

Figure 7:
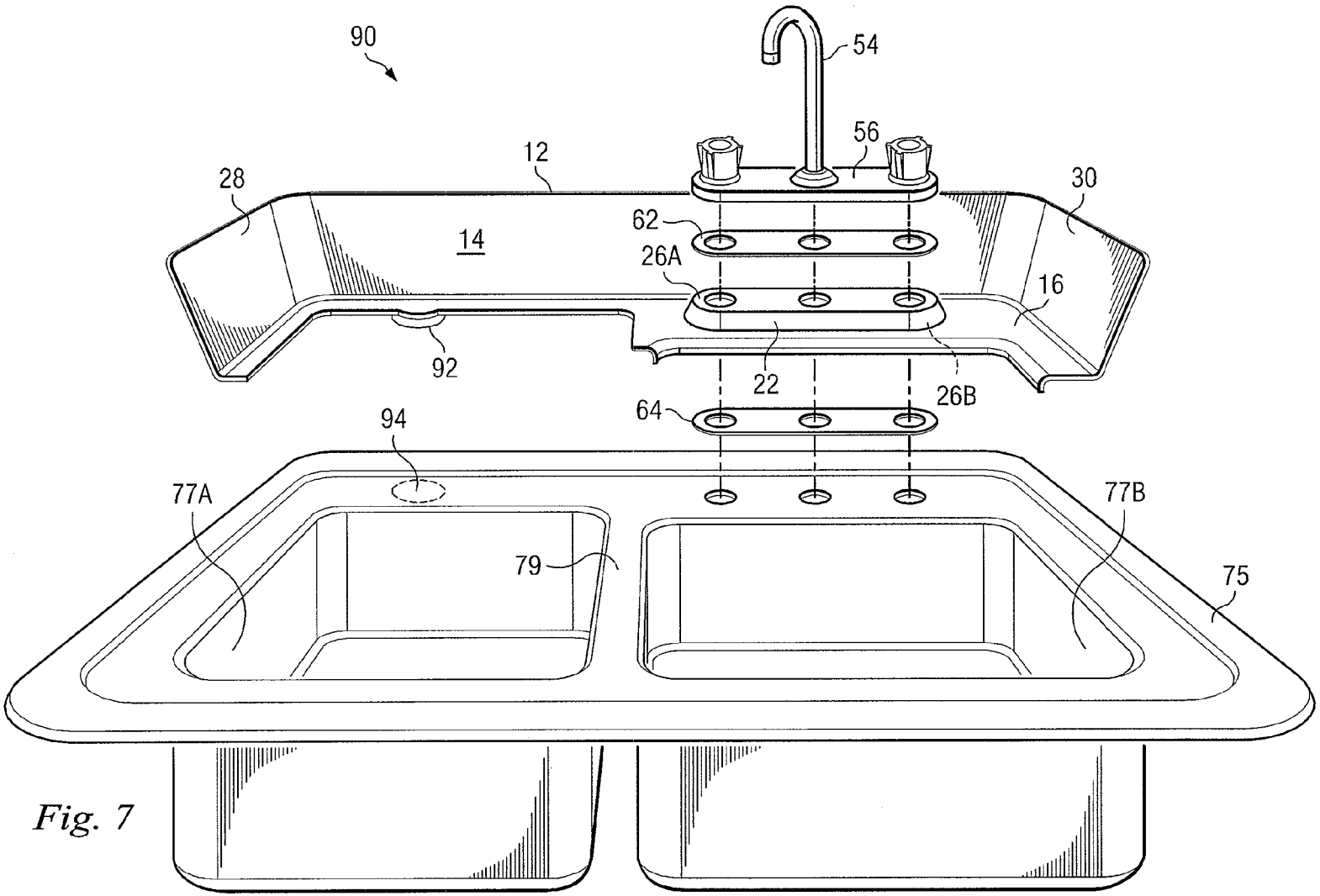
FIG. 7 illustrates an alternate embodiment of a splash guard of the present invention for use with washing basins having their faucet assemblies disposed on one side of the washing basin.

FIG. 7 illustrates an alternate embodiment of a splash guard 90 wherein the faucet assembly is offset to one side or the other for use with washing basins having their faucet assemblies disposed on one side of the washing basin 75. In the figure, the washing basin 75 includes a left side basin 77A and a right side basin 77B separated by a partition 79. Most of the other structures are as described in previous figures. One additional feature of the splash guard 90 illustrated in FIG. 7 is a magnetic foot 92 for securing the end of the splash guard 10 that is not secured (the "free" end) to the washing basin 75 by the faucet assembly 54. The magnetic foot 92, which is intended to contact the washing basin 75 at the location 94 shown in dashed lines, may be used when the washing basin 75 is constructed of steel or an alloy having iron and/or nickel in it. Other methods of securing the "free" end of the splash guard 90 to the washing basin 75 may, of course be used. Such methods may include threaded hardware, epoxy or other adhesives.

Figure 8:
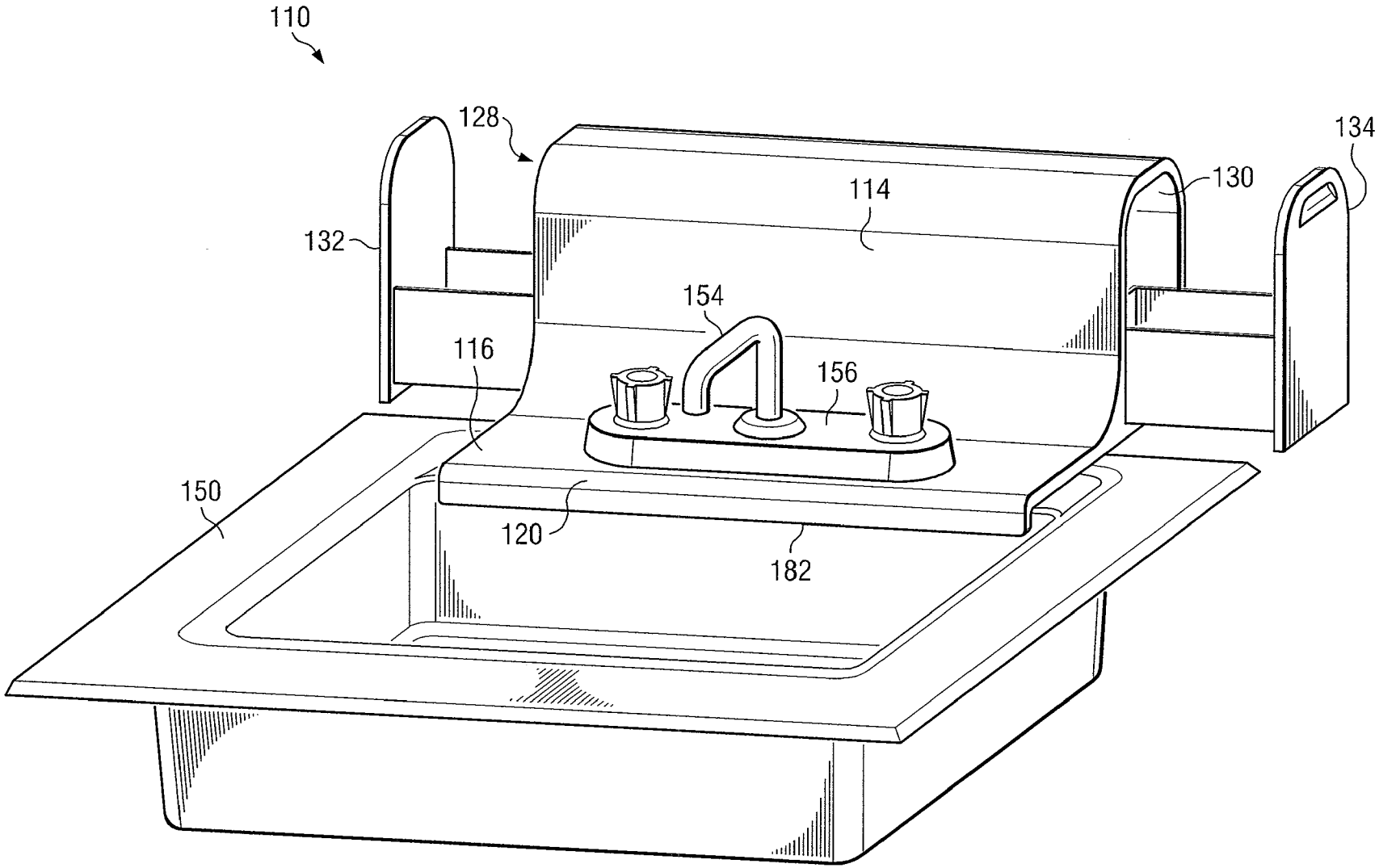
FIG. 8 illustrates an alternate embodiment of the present invention configured with storage drawers in the left and right sides of the splash guard.
Figure 9:
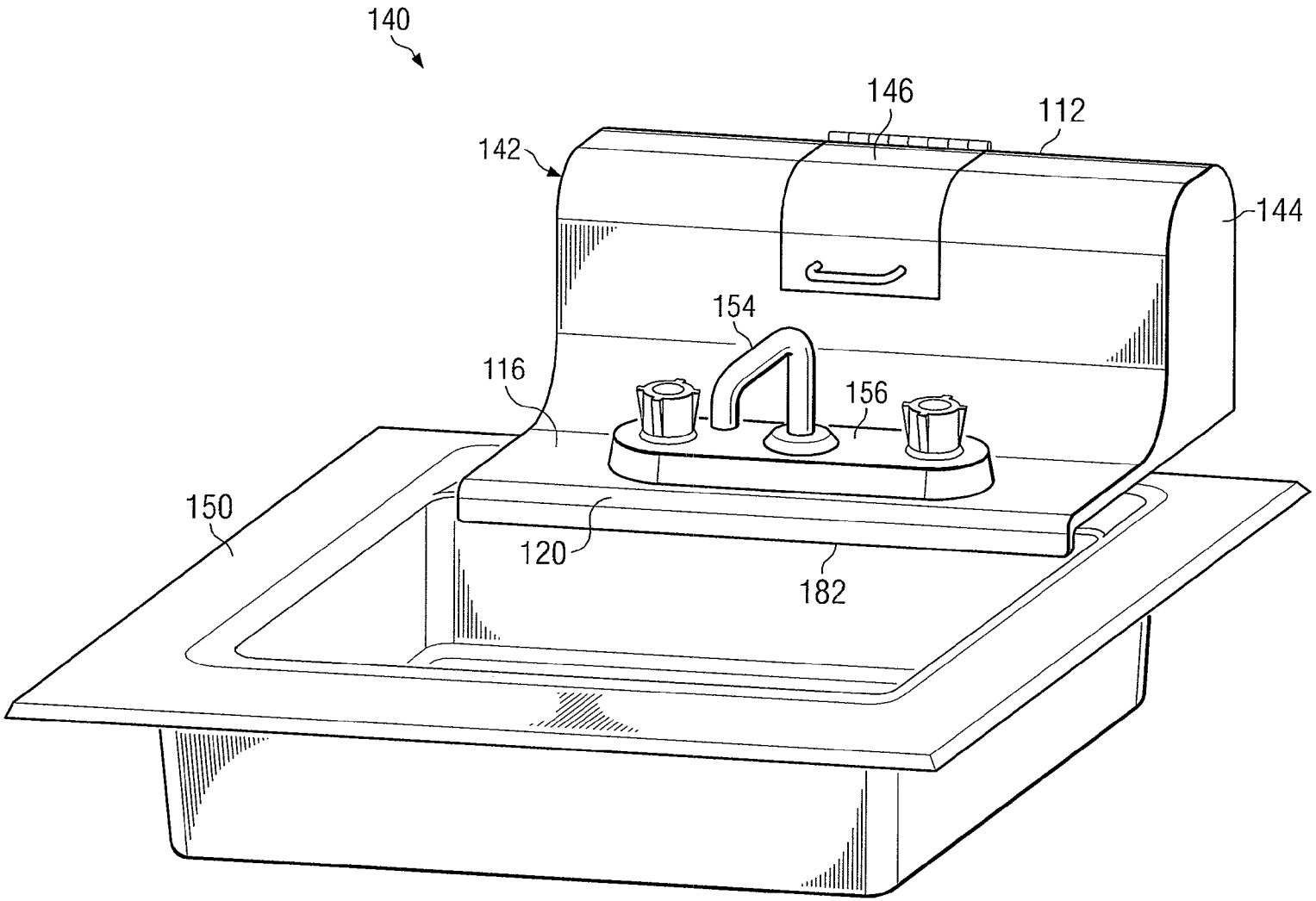
FIG. 9 illustrates an alternate embodiment of the present invention configured with a storage bin and lid therefor.

FIG. 8 illustrates an alternate embodiment of the present invention configured with storage drawers in the left and right sides of the splash guard 110. Certain types of compact washing basins may be amenable to the abbreviated splash guard 110 that is configured with first 132 and second 134 drawer type storage compartments disposed in the left 128 and right 130 ends of the splash guard 110. The splash guard further includes a rear wall portion 114, a floor portion 116, a forward edge 120 and an overhanging lip 182. The splash guard 110 is shown installed on a washing basin 150 that is equipped with a faucet assembly 145 supported on a mounting base 156. A variation of this splash guard is shown in FIG. 9. The splash guard 140 of FIG. 9 embodies a storage compartment accessible by lifting a door 146. The left 142 and right 144 ends of the splash guard enclosure are shown closed. The embodiment of FIG. 9 is otherwise similar to the splash guard 110 illustrated in FIG. 8.

Figure 10:
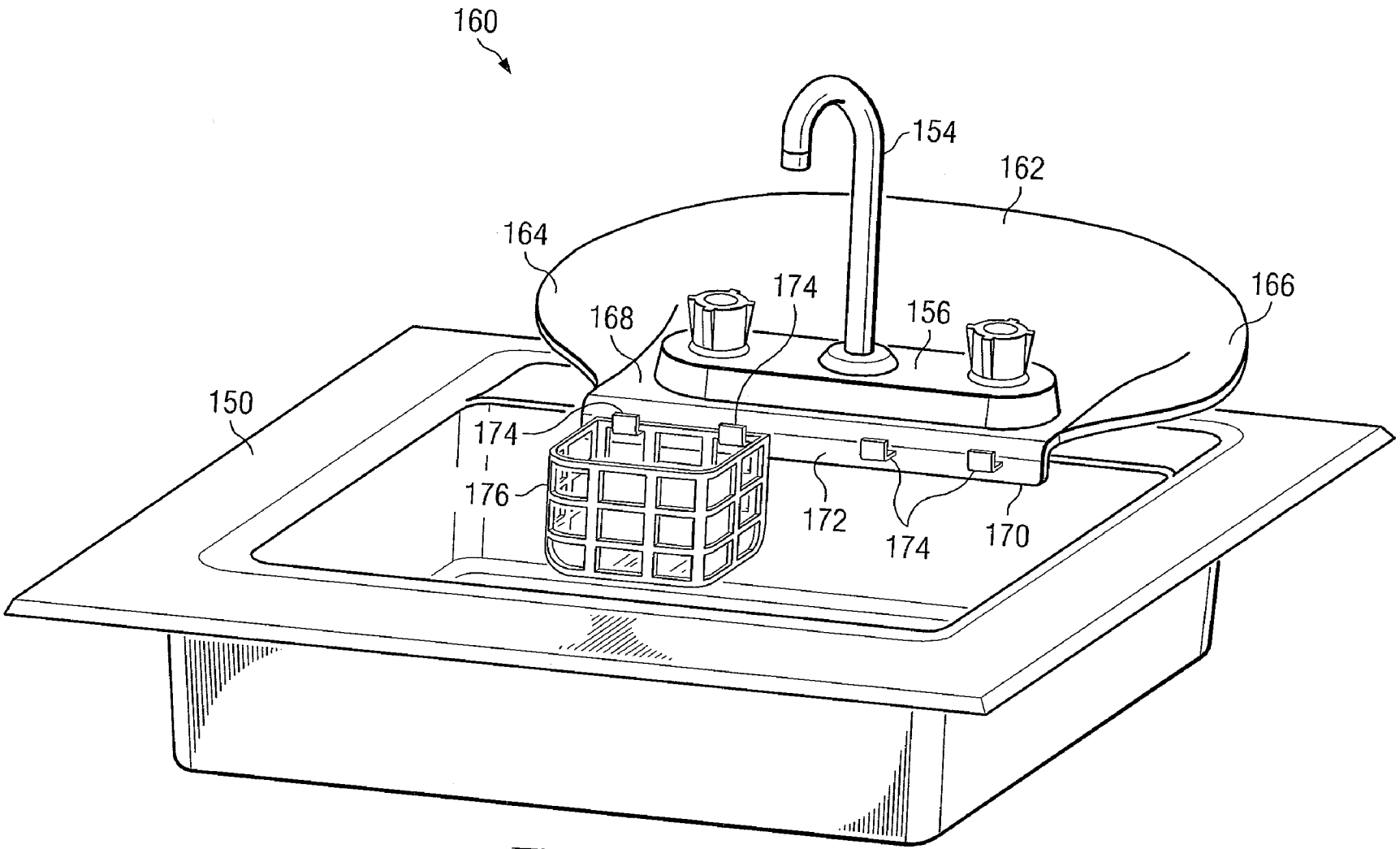
FIG. 10 illustrates an alternate embodiment of the present invention configured with support hooks and an accessory basket supported thereon.

FIG. 10 illustrates an alternate embodiment of the present invention configured with support hooks and an accessory basket supported thereon. The splash guard 160 is shown configured for a small washing basin, lavatory, or sink 150 and is specifically equipped with several hooks 174 disposed along the forward part 172 of the floor portion 168 just above the forward edge 170 thereof. The splash guard shell 162 includes a left side "wing" 164 and a right side "wing" 166 that merge into the floor portion 168 of the splash guard shell 162. A basket 176 is suspended from two of the hooks 174. The basket 176 may be used to store small items associated with the uses of the washing basin 160 such as soap, scrubbing pads or brushes, and the like.

Figure 11:
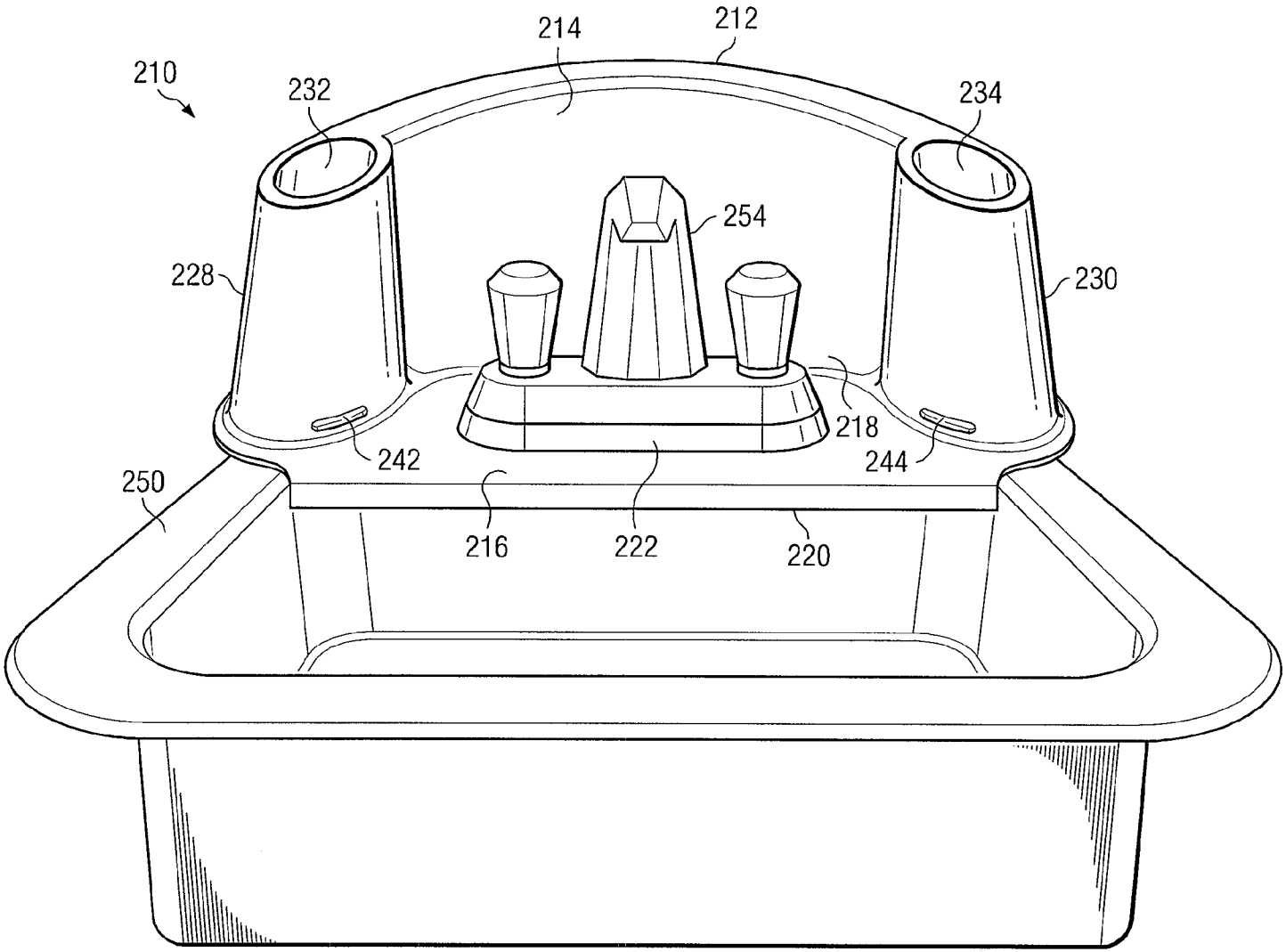
FIG. 11 illustrates an alternate embodiment of the present invention adapted to a small wash basin or lavatory and configured with storage compartments in the left and right sides.
Figure 12:
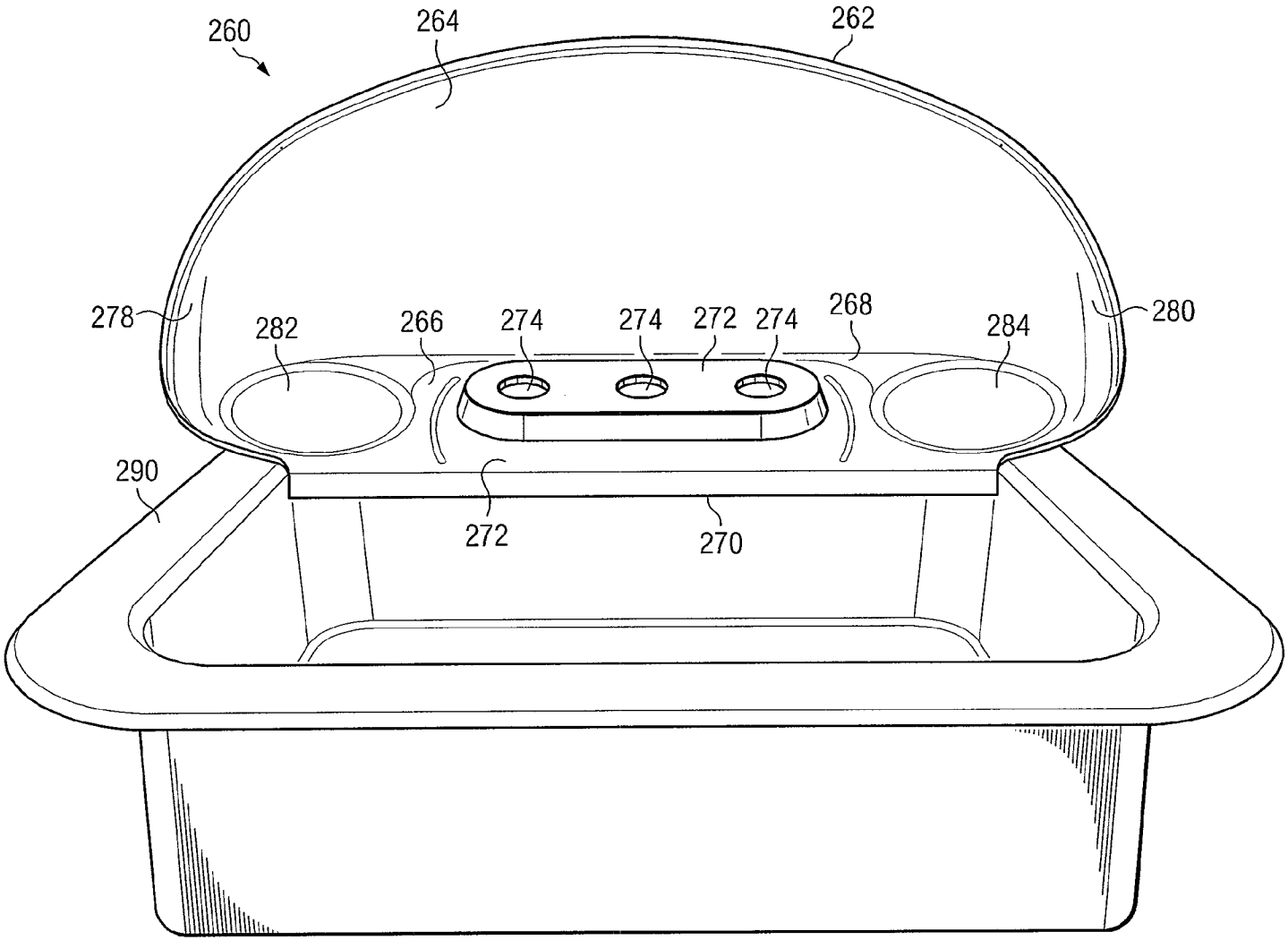
FIG. 12 illustrates an alternate embodiment of the present invention adapted to a small wash basin or lavatory and configured with small shelf areas in the left and right sides.

FIG. 11 illustrates an alternate embodiment of the present invention adapted to a small washing basin, lavatory, or sink 250 and configured with storage compartments 232,234 respectively disposed in the left 228 and right 230 sides of the splash guard 210. In some embodiments, drain holes 242, 244 may be provided in the lower portion of the compartments 232, 234. The splash guard 210 is formed of a one-piece shell 212 having a rear wall portion 214 and a floor portion 216 that extends forward toward a forward edge 220 from a lower side 218 of the rear wall portion 214. A mounting base 222 that is integral with the floor portion 216 of the one-piece shell 212 supports a faucet assembly or fixture 254 thereon in a manner similar to the illustration in FIGS. 3 and 4 herein above. In one version of the embodiment of FIG. 11, the one-piece shell 212 may be formed of clear acrylic or other clear plastic material so that the storage features 232, 234 may permit viewing the contents therein. In fact, the storage features or storage receptacles 232, 234 may even be used as small habitats such as aquaria for small fish. In another embodiment, the receptacles 232, 234 may enclose a light bulb or LED light source (not shown) for use as a night light, for example. In yet another version of the embodiment of FIG. 11, the storage receptacles 232, 234 may be removed to leave two substantially flat platform or shelf areas 282, 284 as storage areas for water glasses, soaps, scrub brushes, etc. (not shown) as illustrated in FIG. 12, which illustrates an alternate embodiment of the present invention adapted to a small wash basin, lavatory, or sink 290 and configured with small shelf areas 282, 284 in the left 278 and right 280 sides of the one-piece shell 262. Other features of the splash guard 260 shown in FIG. 12 include its rear wall portion 264, its floor portion 266, the lower side 268 of the rear wall portion 214, the forward edge 270, and the mounting base 272 for a faucet assembly.

Figure 13:
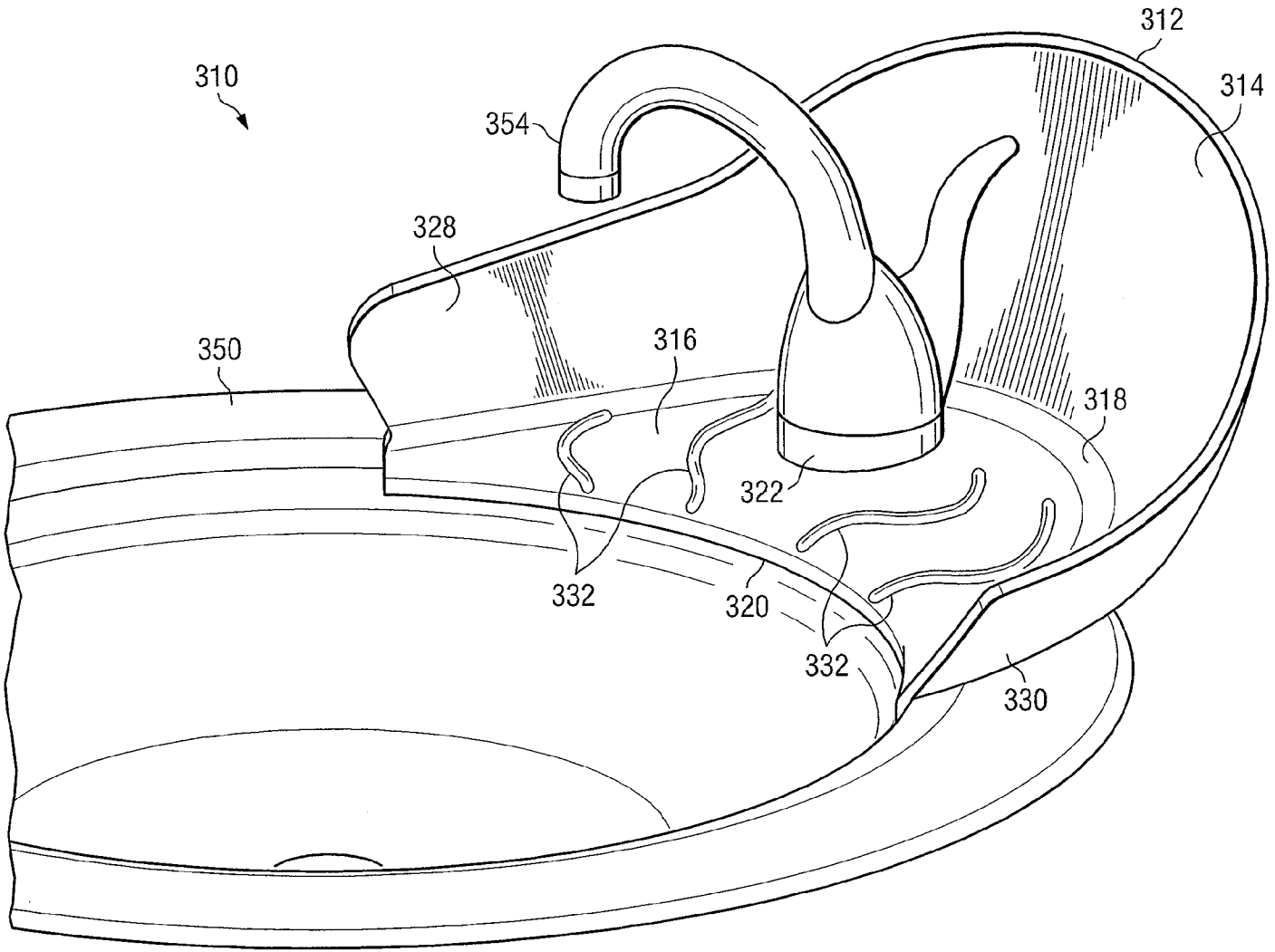
FIG. 13 illustrates an alternate embodiment of the present invention adapted to a small wash basin having a single-stem faucet assembly.

FIG. 13 illustrates yet another alternate embodiment of the present invention adapted to a small wash basin 350 having a single-stem faucet assembly 354 installed thereon. The small washing basin illustrated in FIG. 13 may be representative of a bar sink application or other similar installations. Though the splash guard 310 appears substantially different from others illustrated in the present patent application, it shares the one-piece shell 312 construction having a rear wall portion 314, a floor portion 316, a lower side 318 of the rear wall portion 314, and a forward edge 320 that are similar to the corresponding features described in the previous embodiments. The splash guard 310 in FIG. 13 also includes a mounting base 322 for a faucet fixture 354 that differs from other embodiments in being configured to support a single-stem faucet fixture. The embodiment of FIG. 13 further shows a shape of the splash guard 310 that is closely tailored to the shape of the washing basin 350, as in a custom installation. Guide ridges 332 may be provided similar to those shown in FIGS. 1, 3, 4, and 5.

Figure 14A:
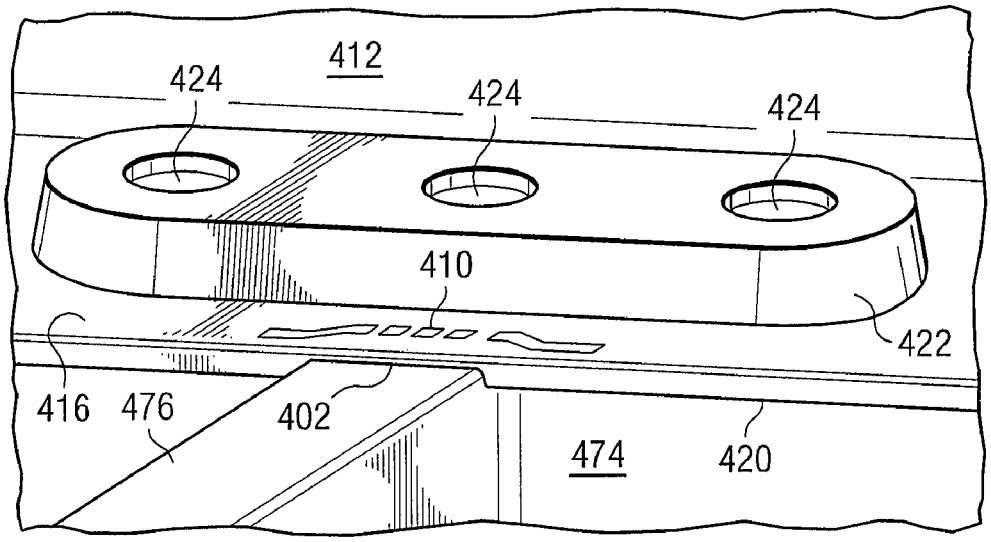
FIG. 14A illustrates an alternate embodiment of the present invention having a clearance louver adapted to a divider wall of a double basin sink.

FIG. 14A illustrates an alternate embodiment of the present invention having a clearance louver or relief adapted to conform to a divider wall of a double basin sink. A portion of the splash guard 412 is shown in the vicinity of the faucet base 422 disposed in the forward floor portion 416 of the splash guard 412. Compare FIG. 14 with FIG. 5 for corresponding details of the splash guard and the double basin sink. The faucet base 422 includes faucet stem openings 424. The splash guard 412 is shown in position upon a double basin sink 474. The forward edge of the splash guard 412 includes the relief 402 that conforms the forward edge 420 to the basin divider 476, to accommodate the slight downward slope (see, e.g., FIG. 2 and the accompanying description) built into the forward floor portion of the splash guard 412 that enables liquid to drain from the splash guard 412 into the sink 474. The relief 402 may be configured as an upset in the shape of the splash guard at that location, somewhat in the manner of a clearance louver.

While the preferred configuration of the relief is to conform to the shape of the basin divider 476, it is further preferred that the relief 402 not be in contact with the upper surface of the basin divider 476 to prevent entrapment of moisture between them due to capillary action. In an alternative embodiment, shown in FIG. 14B (to be described) the relief 402 may be a simple cut out of a portion of the forward edge 420 adjacent the basin divider 476. The splash guard 412 may further include a decorative feature 410 just above and slightly rearward of the relief 402. The decorative feature may be a logo, a brand name, a decorative pattern in a contrasting color or shape applied to or molded into the surface. The decorative feature 410 may also be provided by a decal applied to the surface.

Figure 14B:
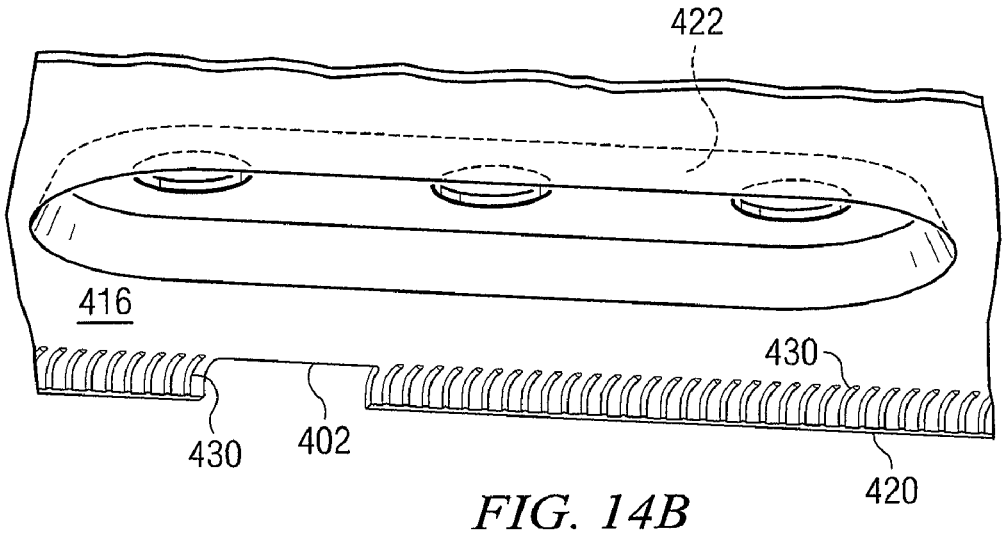
FIG. 14B illustrates an underside view of the embodiment of the splash guard of FIG. 14A.

FIG. 14B illustrates an underside view of the embodiment of the splash guard of FIG. 14A, except that the relief 402 is configured as a simple cut out portion of the forward edge 420 of the splash guard 412. An additional feature of the splash guard 412 visible in FIG. 14A is the ribbed surface 430 consisting of a uniformly spaced row of slightly elevated ridges applied to the underside of the curved underlip of the forward edge 420 just behind the forward edge 420. These ridges 430 rise to an elevation of only a few tens of thousandths of an inch from the surrounding area, e.g., in the range of 0.010 to 0.030 inch. The purpose of the ribs or ridges 430 is two-fold: to provide space for the circulation of air, and to facilitate the dispersal of liquids that may be splashed toward and upon the underside of the forward edge 420. This dispersal is aided by the shape of the ribs in cross section—generally like the crest of a shallow wave—which impairs the effects of surface tension or capillary action. This feature acts to retard the accumulation and growth of bacteria and mold.

Figure 15A:
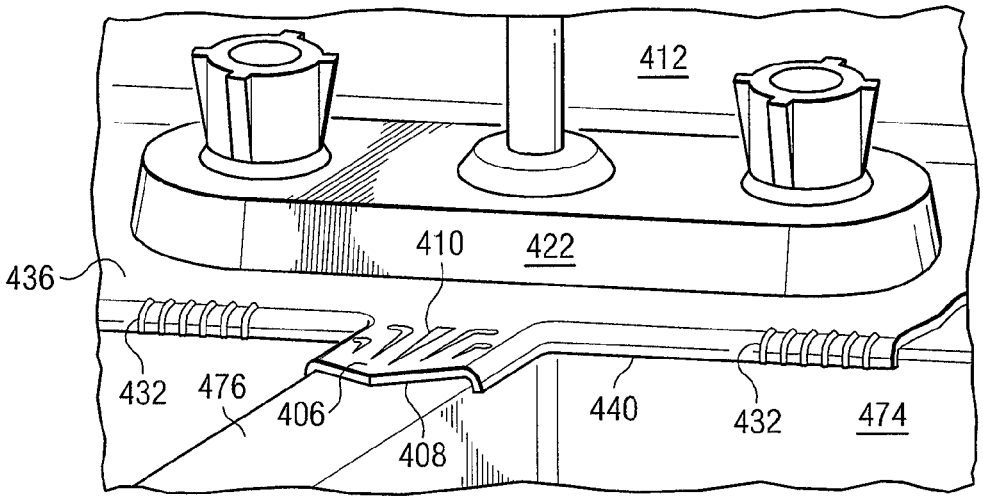
FIG. 15A illustrates an alternate embodiment of the present invention having an extension of the clearance louver of FIG. 14A, also adapted to a divider wall of a double basin sink.

FIG. 15A illustrates an alternate embodiment of the present invention having an extension of the relief 402 of FIG. 14A, 14B, also adapted to a divider wall 476 of a double basin sink 474. The extension 406 shown in FIG. 15A, formed integrally with the forward edge 440 (which is analogous to the forward edge 420 in FIG. 14A, 14B), extends along and over the basin divider 476 of the double basin sink 474. The extension 406 may include a variety of shapes of the extremity 408, such as but not limited to a straight edge, a rounded edge, or the chevron-shaped edge as shown in FIG. 15A. The length of the extension 406 may vary according to practical and styling considerations. The purpose of the extension is to act as a barrier to liquids that alight upon the rearward portion of the basin divider 476. The upper surface of the extension 406 may further include a decorative feature 410 just above and slightly rearward of the extension extremity 408. The decorative feature 410 may be a logo, a brand name, a decorative pattern in a contrasting color or shape applied to or molded into the surface. The decorative feature 410 may also be provided by a decal applied to the surface.

Continuing with FIG. 15A, the extension 406 includes features for dispersing liquids. One such feature is a non-absorbent surface. Another such feature is the uniformly spaced row of slightly elevated ridges or ribs 432 disposed along the forward edge 440 of the splash guard 412 and its extension 406. This row of ribs 432 is configured in a manner similar to the row of ribs described above for FIG. 14B, that is, they rise to an elevation of only a few tens of thousandths of an inch from the surrounding area, e.g., in the range of 0.010 to 0.030 inch. The purpose of the row of ribs or ridges 432 is to facilitate the dispersal of liquids that may be splashed toward and upon the upper surface of the extension 406, as well as along the entire length of the forward edge 440 of the splash guard 412. This dispersal is aided by the shape of the ribs in cross section—generally like the crest of a shallow wave—which impairs the effects of surface tension or capillary action.

Figure 15B:
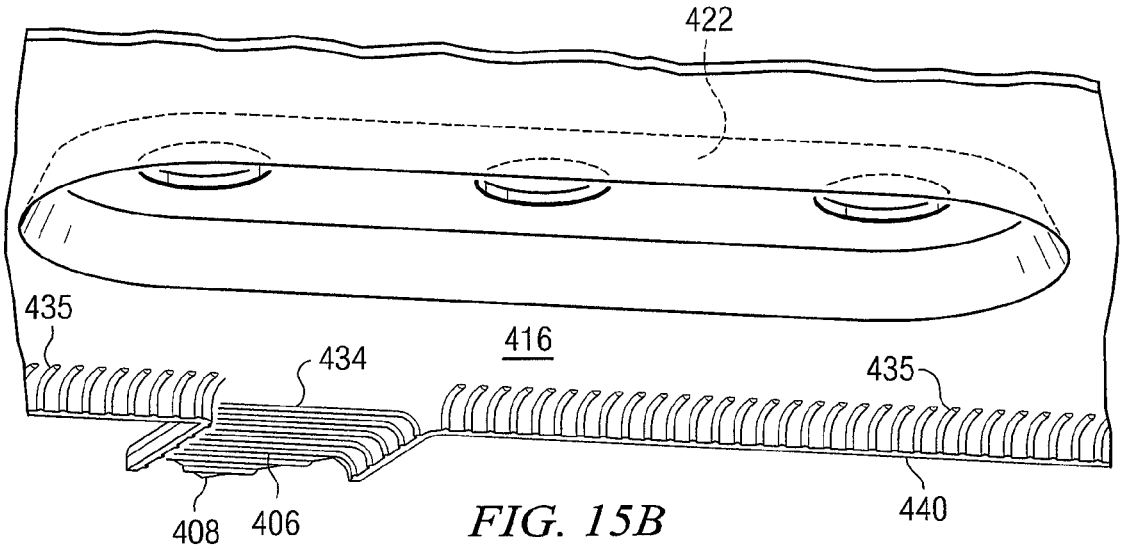
FIG. 15B illustrates an underside view of the embodiment of the splash guard of FIG. 15A.

FIG. 15B illustrates an underside view of the embodiment of the splash guard of FIG. 15A to show features thereon for facilitating the dispersal of liquids. Not only is a uniformly spaced row of slightly elevated ridges or ribs 452 disposed along the underside of the forward edge 440 of the splash guard 412 and its extension 406, but the uniformly spaced ridges or ribs are carried across the underside of the extension 406 in a modified form to disperse water or other liquid material from collecting there between the extension 406 and the upper side of the double basin divider 476. This row of ridges or ribs 452 is configured in a manner similar to the row of ribs described above for FIG. 14A, that is, they rise to an elevation of only a few tens of thousandths of an inch from the surrounding area, e.g., in the range of 0.010 to 0.030 inch. The purpose of the row of ribs or ridges 452 is to facilitate the dispersal of liquids that may be splashed toward and upon the upper surface of the extension 406, as well as along the entire length of the forward edge 440 of the splash guard 412. This dispersal is aided by the shape of the ribs in cross section—generally like the crest of a shallow wave—which impairs the effects of surface tension or capillary action.

While the invention has been shown in only several of its forms, it is not thus limited but is susceptible to various changes and modifications without departing from the spirit thereof. For example, the splash guard of the present invention is susceptible to many variations in shape, size, and color. It is also susceptible to being adapted to a wide variety of sinks, basins, lavatories, etc. and to wide variations in amenities selected to be used with it or incorporated into its design yet still retain the novel features herein described. While the splash guard illustrated and described herein is directed to an add-on product, there is no reason that a washing basin of some form may include as an integral part thereof a splash guard. For example, the washing basin or sink with an integral splash guard as described herein may be molded as a single unit, thus negating the requirement for separate faucet base, gaskets, etc. In some installations, the splash guard may be integrated with a counter surface as a one piece product or as an assembly of separate units.

What is claimed is:

1. A splash guard for installation on a washing basin having a faucet assembly mounted proximate an edge of said basin, said splash guard comprising:

a one piece, generally concave shell having a floor portion with one or more openings for water supply plumbing to said faucet assembly and an upwardly curved rear wall portion integral therewith for directing splashed material impinging thereon into said washing basin; wherein said one or more openings for said water supply plumbing are disposed within a mounting base area within said floor portion and configured as a flat plane slightly elevated from said the surrounding surface of said floor portion of said splash guard;

said floor portion comprises a downward-turned lip disposed along a forward edge thereof and spaced away from said basin, said lip having front and back surfaces configured to direct the flow of liquid material into said basin; and said lip comprises a front surface that curves downward toward said forward edge of said splash guard and a back surface formed into an underside of said floor portion, wherein said front and back surfaces merge to form a drip edge along the forward edge of said splash guard.

2. The splash guard of claim 1, wherein said floor portion slopes slightly downward and forward from said lower side of said rear wall portion toward a forward edge of said floor portion.

3. The splash guard of claim 1, further comprising and disposed just behind said elevated mounting base, a slight downward pitch of the floor portion of the splash guard surface extending laterally from at least one side of a front-to-rear centerline of the splash guard.

4. The splash guard of claim 1, further comprising:

at least one receiving surface for receiving at least one gasket member to seal said one or more openings against passage of fluids between said water supply plumbing and said one or more openings.

5. The splash guard of claim 4, wherein said at least one receiving surface is a first receiving surface disposed on the top side of said one or more openings.

6. The splash guard of claim 1, further comprising:

left and right forward-curving extensions of said upwardly curved rear wall formed to adjoin said floor portion to form said one piece curved shell.

7. The splash guard of claim 1, where in said curved shell comprises:

a shell formed of a polyurethane resin during a cold casting process.

8. The splash guard of claim 7, wherein said polyurethane resin further comprises:

an additive material for decorative purposes.

9. The splash guard of claim 8, wherein the additive material includes at least one material selected from the group of metals consisting of aluminum, brass, bronze, chromium, copper, gold, nickle, silver, and zinc.

10. The splash guard of claim 8, wherein the additive material includes at least one material selected from the group of non-metals consisting of glass, minerals, pigments, plastics, stone, and other materials of organic origin.

11. The splash guard of claim 1, wherein said curved shell is fabricated using a process selected from the group consisting of:

cold casting, cold forming, hydro-forming, injection molding, and vacuum forming.

12. The splash guard of claim 1, comprising:

at least one storage compartment formed therein having an access door configured to disperse liquid material splashed thereon.

13. The splash guard of claim 1, comprising:

at least one storage fixture for an article disposed on the splash guard.

14. An attachment for a washing basin, comprising in combination: the splash guard of claim 1; and a gasket disposed between the splash guard and the washing basin.

15. The splash guard of claim 1, wherein the mounting base area is configured to fit under a standard faucet fixture mounting base, such that the underside of the forward floor portion of the splash guard rests against the upper surface of the washing basin.

16. The splash guard of claim 1, wherein:

said back surface of said lip is spaced away from said basin by a gasket positioned there between, said gasket disposed away from said downward-turned lip formed along said forward edge.

17. The splash guard of claim 1, further comprising:

a uniformly spaced row of slightly elevated ridges applied to said underside of said forward edge of said lip.

18. A splash guard for installation on a washing basin having a faucet assembly mounted proximate an edge of said basin, said splash guard comprising:

a one piece shell having a substantially vertical rear wall portion and a substantially horizontal forward floor portion extending from a lower side of said rear wall portion; wherein said forward floor portion includes a mounting base area configured as a flat plane slightly elevated from the forward floor portion and having one or more openings for water supply plumbing disposed within said mounting base area; and said forward floor portion includes a slight downward slope forward from said rear wall portion toward a forward edge of said forward floor portion.

19. The splash guard of claim 18, further comprising and disposed just behind said elevated mounting base, a slight downward pitch of the forward floor portion of the splash guard surface from a front-to-rear centerline of the splash guard toward both left and right directions.

* * * * *